US007575059B2

(12) United States Patent
Jaques et al.

(10) Patent No.: US 7,575,059 B2
(45) Date of Patent: Aug. 18, 2009

(54) SONDE DEPLOYMENT

(75) Inventors: Paul Steven Jaques, Cornwall (GB); Robert Hughes Jones, Cornwall (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 299 days.

(21) Appl. No.: 11/720,069

(22) PCT Filed: Dec. 7, 2005

(86) PCT No.: PCT/IB2005/003690

§ 371 (c)(1),
(2), (4) Date: May 23, 2007

(87) PCT Pub. No.: WO2006/061694

PCT Pub. Date: Jun. 15, 2006

(65) Prior Publication Data

US 2008/0093090 A1 Apr. 24, 2008

(30) Foreign Application Priority Data

Dec. 9, 2004 (GB) ..... 0426980.9

(51) Int. Cl.
*E21B 47/01* (2006.01)

(52) U.S. Cl. ..... 166/382; 166/250.11; 166/66

(58) Field of Classification Search ..... 166/250.11, 166/66

See application file for complete search history.

(56) References Cited

U.S. PATENT DOCUMENTS 6,364,772 B1 * 4/2002 Sugden ..... 464/31

FOREIGN PATENT DOCUMENTS

WO WO03/027717 A1 * 4/2003

* cited by examiner

*Primary Examiner*—Jennifer H Gay
*Assistant Examiner*—Cathleen R Hutchins
(74) *Attorney, Agent, or Firm*—Matthias Abrell; Jaime Castano; Dale Gaudier

(57) ABSTRACT

Apparatus is disclosed for securing a sonde to the inner wall of a well casing (3). The sonde (2) comprises a clamp (2) expandable from a contracted position to an expanded position in which the clamp can engage the inner wall. The securing apparatus comprises a member (5,6) for releasably engaging with the clamp (2) to hold the clamp in the contracted position; a spring (7) connected to the member such that when the spring is in a compressed state, the member is constrained into engagement with the clamp to hold the clamp in the contracted position; and a mechanism (8,9,10) for holding the spring (7) in its compressed state during a 10 first mode of operation and, in a second mode of operation, for releasing the spring (7) from its compressed state thus disengaging the member (5,6) from the clamp to permit the clamp to expand into its expanded position, the mechanism including a material (11) which in the first mode of operation, is in a solid state and, in the second mode of operation, is in a liquid state.

19 Claims, 4 Drawing Sheets

SONDE DEPLOYMENT

This invention relates to securing a sonde to the inner wall of a well casing and methods for deploying a sonde within a well.

BACKGROUND

Microseismic analysis of the geological strata around the bore of fluid injection and production wells is typically effected by the use of seismic sensor assemblies (sondes), mounted downhole in the area of the fluid flow. Usually a number of sondes are mounted in the well at different levels in the bore. Deployment techniques have been developed to allow the sensors to become almost completely mechanically decoupled from the flow induced noise from the tubing.

Systems for permanently installing a sonde against an inner wall of a pipe, such as the casing of a fluid extraction well, are known. Such systems are described in, for example, U.S. Pat. Nos. 5,092,423, 5,181,565, 5,200,581, 5,111,903, 6,289,985, 6,173,804 and 5,318,129.

A sonde may comprise a clamp which permanently or semi-permanently engages with the inner casing of a well. For example, the clamp may be lowered into the well in a retracted state and then once in position expanded to engage with the well casing using a pressure actuated system, which may use external pressure sources or well pressure. Such a clamp is described in EP-A-1 370 891, the contents of which are incorporated herein by reference, which describes C-shaped ring clamps.

These systems may be set using hydraulic pressure derived from the surface using either tubing pressure, annulus pressure or a dedicated hydraulic control line. Disadvantages of these systems are that they are expensive, can suffer from reliability problems and the method of setting the sonde can be driven by the type of well completion.

It is an object of the present invention to provide a sonde securing means and deployment method which overcomes the problems associated with hydraulically actuated systems by providing more simple method of actuation, requiring no surface operational activity.

SUMMARY OF THE INVENTION

The releasing mechanism for setting a sonde using hydraulic pressure may involve a hydraulic cylinder with a piston and rod that moves when hydraulic pressure is applied. By replacing such an arrangement with a spring-loaded mechanism, this can be used to release the sonde into its clamped position.

In this invention, a sonde may be initially 'primed' or 'loaded' with the spring set in an compressed position, and then latched in place using a eutectic fusible alloy. The sonde may then be lowered into the well to the desired location. The release of the spring is then enabled by the increase in temperature which occurs in the well, either due to the natural thermal gradient or the production of hot fluid from the reservoir, causing a clamp comprising the sonde to expand and engage with the well casing.

A eutectic fusible alloy such as, for example, Wood's metal which is bismuth based has the characteristic of being liquid at temperatures below 250° C. The exact melting point can be set to suit the application, by variation of the proportions of the constituents of the alloy.

Slow release of the mechanism may be achieved by adding a damping mechanism, such as a throttled cylinder full of fluid that can only exit via a small output nozzle providing flow control of the melted eutectic.

In accordance with a first aspect of the present invention, there is provided apparatus for securing a sonde to the inner wall of a well casing, the sonde comprising a clamp expandable from a contracted position to an expanded position in which the clamp can engage said inner wall, wherein the apparatus comprises: a member for releasably engaging with the clamp to hold the clamp in said contracted position; a spring connected to the member such that, when the spring is in a compressed state, the member is constrained into engagement with the clamp to hold said clamp in the contracted position; and a mechanism for holding the spring in its compressed state during a first mode of operation and, in a second mode of operation, for releasing the spring from its compressed state thus disengaging the member from the clamp to permit the clamp to expand into said expanded position, the mechanism including a material which, in said first mode of operation, is in a solid state and, in said second mode of operation, is in a fluid, i.e. liquid or gaseous, state.

Preferably, an additional member is provided for releasably engaging with the clamp.

Advantageously, the mechanism comprises a piston which is restrained from moving when the material is in a solid state, but which is free to move when the material is in a fluid or, in a preferred variant, a liquid state. The piston may connected to the member and housed within a housing. In this instance, the additional member may be connected to the housing. In the first mode of operation, the solid material may be contained within the housing, preventing movement of the piston. A return path may be provided linking one end of the housing to an opposite end of the housing. In the second mode of operation, the liquid material may be free to flow through the return path. The dimensions of the housing and the return path may be selected so that liquid material flows therethrough at a predetermined rate. This may provide suitable damping of the spring release.

Preferably, the material is an alloy, such as a eutectic. Such a material is Wood's metal.

In accordance with a second aspect of the present invention, there is provided a method for deploying a sonde within a well, the sonde comprising a clamp expandable from a contracted position to an expanded position in which the clamp is secured against the inner wall of a casing of the well, comprising the steps of:

- providing apparatus in accordance with the invention in engagement with the clamp;
- locating the apparatus and the clamp at a desired location in the well; and
- liquefying the material to release the spring and disengage the member from the clamp so that the clamp expands towards the inner wall of the casing.

In accordance with a third aspect of the present invention, there is provided a method for deploying a sonde within a well, the sonde comprising a clamp expandable from a contracted position to an expanded position in which the clamp is secured against the inner wall of a casing of the well comprising the steps of:

- providing securing apparatus comprising: a member engaged with the clamp to hold the clamp in said contracted position; a spring connected to the member; and a holding mechanism for the spring;
- restraining the apparatus such that the clamp is held in its contracted position and the spring is compressed;
- introducing liquid material into the holding mechanism;
- solidifying the material, thus maintaining the clamp in its contracted state and the compression of the spring;

introducing the sonde and securing apparatus into a well and lowering it to its required location; and liquefying the material to release the spring and disengage the member from the clamp so that the clamp expands towards the inner wall of the casing.

The material may be liquefied as a result of the ambient temperature at the desired location in the well.

Alternatively, the material may be liquefied due to the production of relatively hot fluid from the well or by fluid injected from the surface, e.g., through the deployment tube, which could be a production tubing.

DESCRIPTION OF DRAWINGS

Embodiments of the invention will now be described with reference to the accompanying drawings, in which.

DETAILED DESCRIPTION

Figure 1:
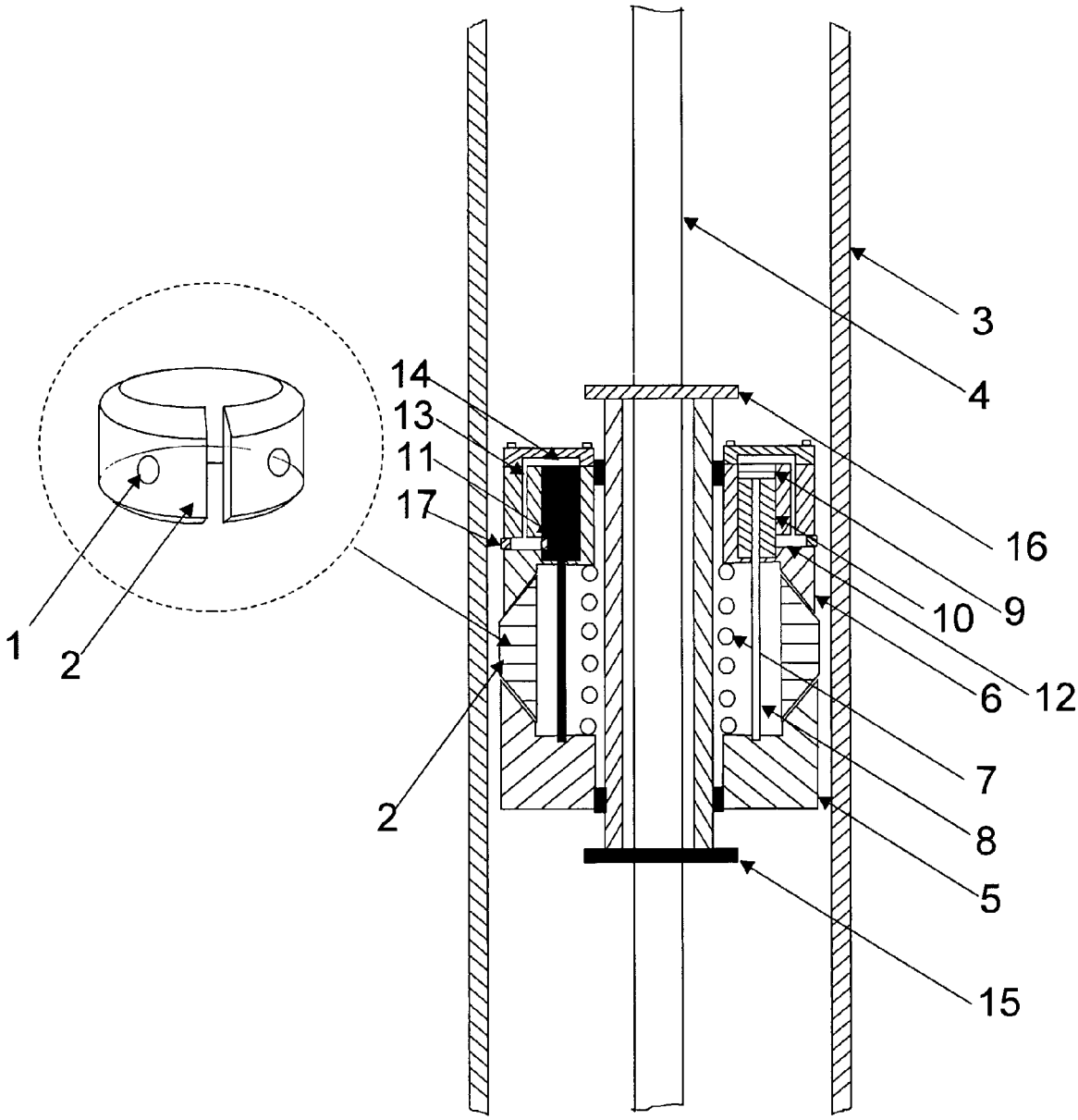
FIG. 1 shows a sonde comprising a C-shaped clamp in its unexpanded state.
Figure 2:
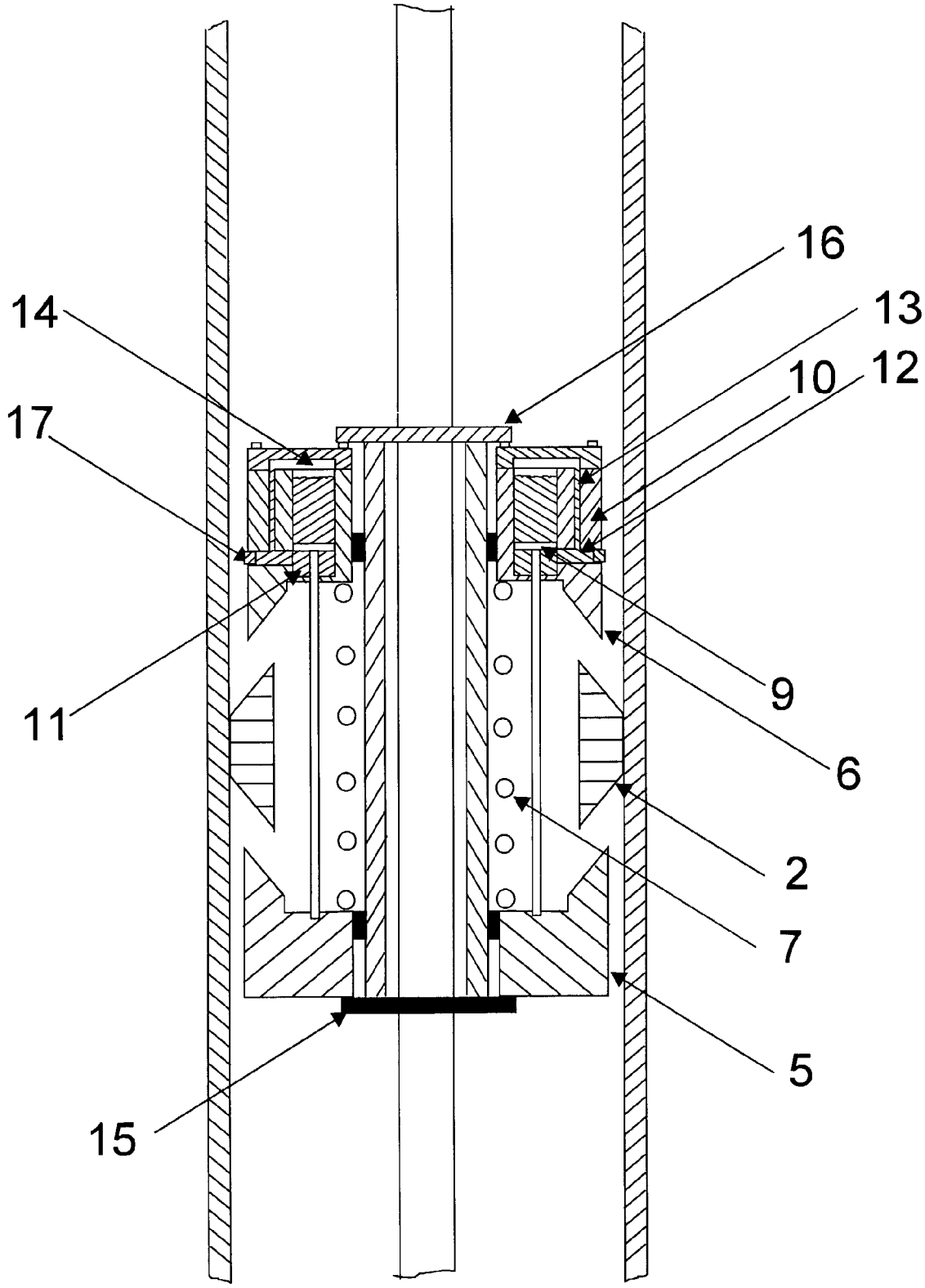
FIG. 2 shows the sonde of FIG. 1 but after expansion of the clamp.

FIGS. 1 and 2 illustrate a first embodiment of the invention used for deployment of a sonde comprising a C-shaped clamp as described in EP-A-1 370 891. Typically four acoustic sensors 1 are mounted in the C-shaped clamp 2. The necessary electrical connections to the sondes have been omitted for clarity.

FIG. 1 shows the sonde clamp mechanism 'loaded' ready for release and lowered into a well between a well casing 3 and production tubing 4. The clamp 2 is held in a contracted position by two chamfered circular jaws 5 and 6. A spring 7 is connected between them, also held in compression, prior to installation of the sonde into the well. The lower jaw 5 is connected via attached rods 8 to pistons 9 in cylinders 10. The cylinders 10 are filled with a solid eutectic 11 with a melting point tailored to suit the temperature at the well depth at which the clamp is required to release. Being a eutectic, the melting point is sharply defined. The bottom of each piston cylinder is linked to its top by bores 12 and 13 within the jaw 6, connecting to a clearance in the cylinder heads 14, providing a return path for the eutectic 11 to flow through when it melts. The diameter of the bore 13 is chosen, taking into consideration its length, to provide fluid flow limitation to the melted eutectic 11, thus providing damping of the clamp release action and controlled placing of the sensitive sonde to the well casing when the eutectic melts.

FIG. 2 shows the release mechanism in its state when the sonde clamp is released. When the eutectic 11 melts, the piston 9 is free to move down the cylinder 10, thus allowing the compressed spring 7 to push apart the jaws 5 and 6 and so release the sonde clamp ring 2. During this process the pistons 9 force the melted eutectic 11 out of the cylinders 10 and through the bores 12 and 13 and into the cylinders 10, via the clearance in cylinder heads 14. The release time is determined by the flow rate limitation, through friction, through the flow control bore 13. The movement of the jaws 5 and 6 is limited by the end stops 15 and 16.

'Loading' of the assembly is achieved as follows. Prior to its insertion in the well, the mechanism has no eutectic in the cylinders 10. The jaws 5 and 6 are forced together manually, e.g. by G-Clamps, thus forcing the sonde clamp ring 2 to compress by virtue of the chamfered faces on both the clamp 2 and the jaws 5 and 6. At the same time, the spring 7 is compressed. With the assembly mounted horizontally, plugs 17 are removed, providing access to a filling port 12 into the cylinders 10. With either of the ports 12 vertical, melted eutectic is poured into the cylinder 10 sufficient to fill it, via the filling bore 12. When the eutectic has cooled to a solid, the assembly is rotated to leave the second port vertical and the second cylinder is then also filled with eutectic. When the eutectic has solidified, the sealing plugs 17 are replaced and the clamp holding the jaws 5 and 6 is released. The mechanism is then 'loaded' and ready to insert in the well. The assembly is then typically attached to the fluid production tubing 4 and lowered to the required position as the tubing 4 is installed in the well or lowered over the tubing 4 using workover tools. The clamp itself is typically not directly attached to the tubing, to reduce the transfer of flow noise from the tubing to the sensors 1, and so only the release assembly will be connected to the tubing. After deployment of the sonde, the release mechanism remains in the well, attached to the tubing.

The first embodiment described above incorporates two eutectic filled cylinders which provides for symmetrical release of the jaws to minimise the risk of mechanical jamming of the mechanism. However, any suitable number of pistons may be employed from one upwards.

Figure 3:
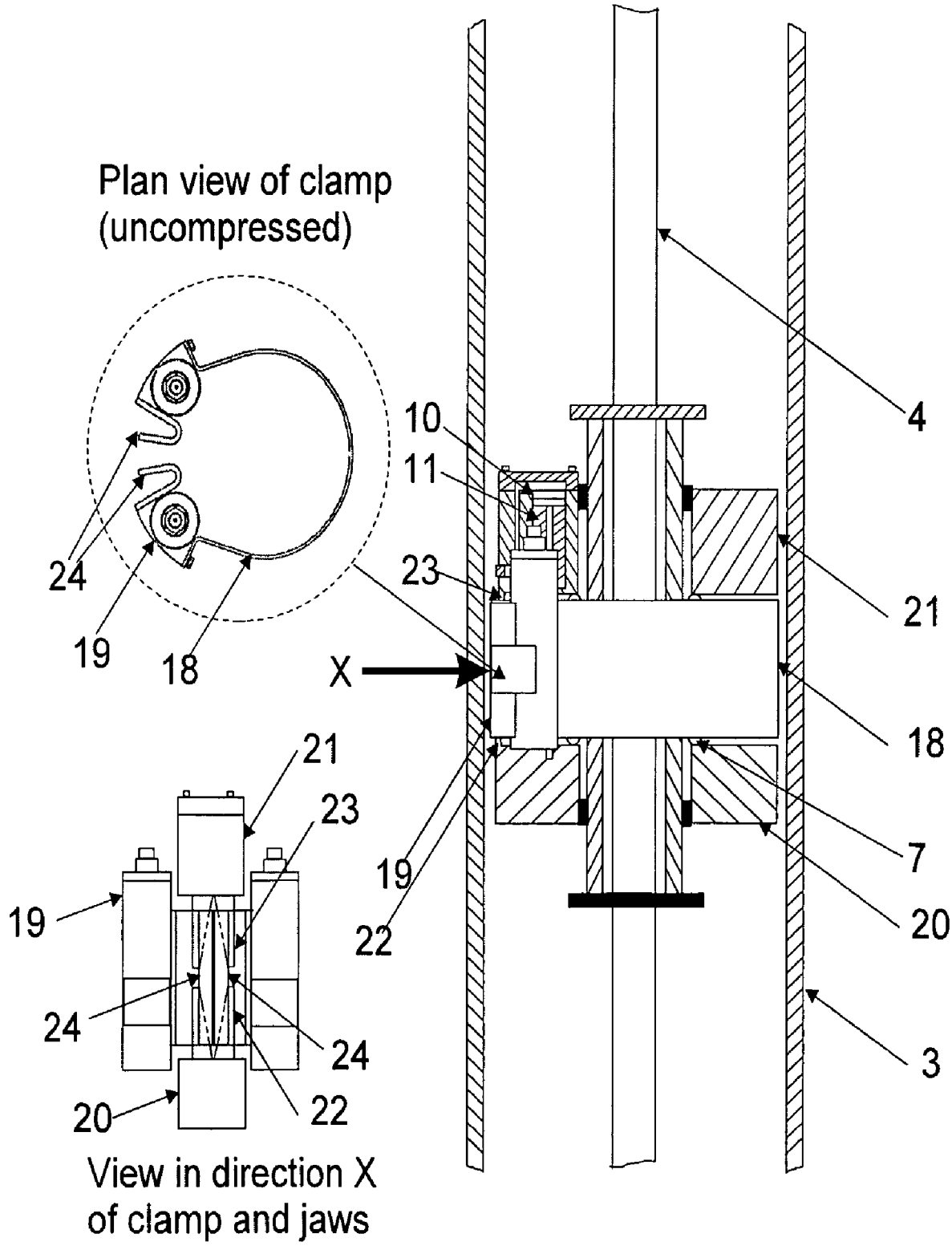
FIG. 3 shows a sonde comprising an alternative form of C-shaped clamp in its unexpanded state.
Figure 4:
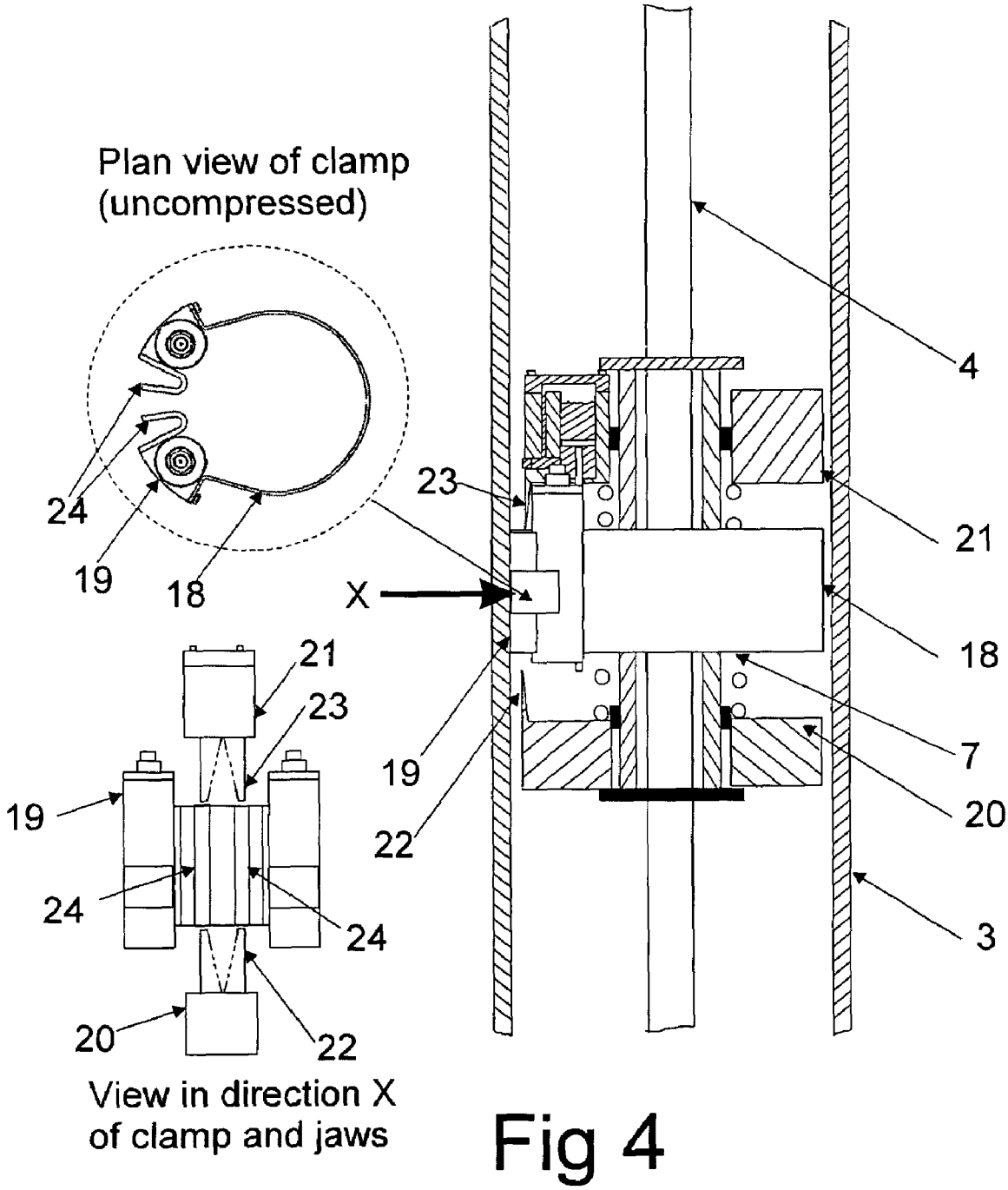
FIG. 4 shows the sonde of FIG. 4 after expansion of the clamp.

FIG. 3 shows a second embodiment using a different form of C-shaped ring sonde clamp 18 carrying sonde packs 19, consisting of typically four sensors arranged in a tetrahedral configuration. The clamp 18 has a "spring-ring" which tends to move the ends of the clamp outwards into an expanded position. The clamp also includes lugs 24 at its ends for control of the clamp, as will be described later. FIG. 3 shows the sonde clamp mechanism 'loaded' ready for release and positioned in the well between the casing 3 and the tubing 4. In this embodiment, the jaws 20 and 21 are rectangular with forks 22 and 23 at respective ends. The jaws and the eutectic operating mechanism are show as a section view, whereas the clamp is shown not sectioned. The mechanism for holding together and releasing the jaws 20 and 21 is similar to that described above for the first embodiment. However, only one cylinder 10 filled with eutectic 11 is shown in FIGS. 3 and 4 as there is no need for symmetrical release of the jaws, the clamp compression being effected by forks at one end of the jaws only and not by chamfered circular jaws as employed in the first embodiment. With the jaws 20 and 21 in the position shown in FIG. 3, the lugs 24 engage with the forks 22 and 23, such that the V-shaped section of the forks draws the lugs 24 together and compresses the spring-ring of the clamp 18 so that the clamp is in a contracted position. As with the first embodiment, a spring 7 (the ends being just visible) connected between the jaws 20 and 21 is also held in compression, prior to installation of the sonde into a well. Again, the clamp is held in this contracted position by the presence of the solid eutectic 11 in piston cylinder 10 preventing movement of the piston.

FIG. 4 shows the release mechanism when the sonde clamp is released in the well by the melting of the eutectic 11 and the controlled release of the jaws 20 and 21 forced apart by the spring 7. The forks 22 and 23 are disengaged from the clamp spring lugs 24, thus allowing the C-shaped ring sonde clamp 18 to expand and clamp the sondes to the well casing 3.

'Loading' of the assembly and its deployment in the well is achieved in a similar manner to the first embodiment.

It should be noted that the above embodiments are exemplary only, and the scope of the invention is limited only by the accompanying claims. Various alternatives will be apparent to those skilled in the art.

For example, in the embodiments above, a eutectic is used as it has the advantageous feature of a sharply-defined melting point. However, theoretically any material which has, or can be made to have, a melting point at the desired temperature may be employed in place of the eutectic.

In addition, it is also envisaged that the present invention may be used to provide a back-up system to a conventional hydraulically operated deployment system, by the simple incorporation of the present system into a hydraulically-operable system.

The invention claimed is:

1. An apparatus for securing a sonde to an inner wall of a well casing, the sonde comprising a clamp expandable from a contracted position to an expanded position in which the clamp can engage said inner wall, wherein the apparatus comprises: a member for releasably engaging with the clamp to hold the clamp in said contracted position; a spring connected to the member such that, when the spring is in a compressed state, the member is constrained into engagement with the clamp to hold said clamp in the contracted position; and a mechanism for holding the spring in the compressed state during a first mode of operation and, in a second mode of operation, for releasing the spring from the compressed state thus disengaging the member from the clamp to permit the clamp to expand into said expanded position, the mechanism including a material which, in said first mode of operation, is in a solid state and, in said second mode of operation, is in a liquid state.

2. The apparatus according to claim 1, comprising an additional member for releasably engaging with the clamp.

3. The apparatus according to claim 2, wherein the additional member is connected to the housing.

4. The apparatus according to claim 1, wherein the mechanism comprises a piston which is restrained from moving when the material is in a solid state, but which is free to move when the material is in a liquid state.

5. The apparatus according to claim 4, wherein the piston is connected to the member.

6. The apparatus according to claim 4, wherein the piston is housed within a housing.

7. The apparatus according to claim 6, wherein in the first mode of operation, the solid state material is contained within the housing, preventing movement of the piston.

8. The apparatus according to claim 7, wherein a return path is provided linking one end of the housing to an opposite end of the housing.

9. The apparatus according to claim 8, wherein in the second mode of operation, the liquid state material is free to flow through the return path.

10. The apparatus according to claim 9, wherein the dimensions of the housing and the return path are selected so that liquid material flows therethrough at a predetermined rate.

11. The apparatus according to claim 1, wherein the material is an alloy.

12. The apparatus according to claim 11, wherein the material is a eutectic material.

13. The apparatus according to claim 12, wherein the material is Wood's metal.

14. A method for deploying a sonde within a well, the sonde comprising a clamp expandable from a contracted position to an expanded position in which the clamp is secured against the inner wall of a casing of the well, comprising the steps of:

providing the apparatus in accordance with any preceding claim in engagement with the clamp;

locating the apparatus and the clamp at a desired location in the well; and liquefying the material to release the spring and disengage the member from the clamp so that the clamp expands towards the inner wall of the casing.

15. The method according to claim 14, wherein the material is liquefied as a result of the ambient temperature at the desired location in the well.

16. The method according to claim 14, wherein the material is liquefied due to the production of relatively hot fluid from the well.

17. A method for deploying a sonde within a well, the sonde comprising a clamp expandable from a contracted position to an expanded position in which the clamp is secured against the inner wall of a casing of the well, comprising the steps of:

providing securing apparatus comprising: a member engaged with the clamp to hold the clamp in said contracted position; a spring connected to the member; and a holding mechanism for the spring;

restraining the securing apparatus such that the clamp is held in the contracted position and the spring is compressed;

introducing liquid material into the holding mechanism;

solidifying the material, thus maintaining the clamp in the contracted state and the compression of the spring;

introducing the sonde and securing apparatus into a well and lowering the sonde to the required location; and liquefying the material to release the spring and disengage the member from the clamp so that the clamp expands towards the inner wall of the casing.

18. The method according claim 17, wherein the material is liquefied as a result of the ambient temperature at the desired location in the well.

19. The method according to claim 17, wherein the material is liquefied due to the production of relatively hot fluid from the well.

* * * * *